US008469021B2

(12) United States Patent
Atemboski et al.

(10) Patent No.: US 8,469,021 B2
(45) Date of Patent: Jun. 25, 2013

(54) FIREPLACE ASSEMBLY WITH INTEGRATED BURN CONTROL SYSTEM

(75) Inventors: Alan R. Atemboski, Renton, WA (US); Kurt W. F. Rumens, Kirkland, WA (US); William R. Fotheringham, Everett, WA (US); Kenneth R. Sandness, Kenmore, WA (US); Brett D. Armitage, Bothell, WA (US); Lawrence Franchimon, Arlington, WA (US)

(73) Assignee: Travis Industries, Inc., Mukilteo, WA (US)

( * ) Notice: Subject to any disclaimer, the term of this patent is extended or adjusted under 35 U.S.C. 154(b) by 416 days.

(21) Appl. No.: 12/697,178

(22) Filed: Jan. 29, 2010

(65) Prior Publication Data

US 2010/0326421 A1 Dec. 30, 2010

Related U.S. Application Data

(60) Provisional application No. 61/161,703, filed on Mar. 19, 2009.

(51) Int. Cl.
*F24B 1/191* (2006.01)

(52) U.S. Cl.
USPC ..... 126/502; 126/512; 431/8; 431/12; 431/37; 236/51

(58) Field of Classification Search
USPC ..... 126/502, 512, 541, 544; 431/8, 12, 431/37, 354; 236/51
See application file for complete search history.

(56) References Cited

U.S. PATENT DOCUMENTS

| | | | | |
|---|---|---|---|---|
| 4,726,351 | A | 2/1988 | Whittaker et al. | |
| 4,962,750 | A | 10/1990 | Bridgewater | |
| 5,020,988 | A | 6/1991 | Peterson | |
| 6,138,667 | A | 10/2000 | Cakebread | |
| 6,145,502 | A | 11/2000 | Lyons et al. | |
| 6,443,726 | B2 | 9/2002 | Atemboski et al. | |
| 6,602,068 | B2 | 8/2003 | Atemboski et al. | |
| 6,953,037 | B2 | 10/2005 | Rumens | |
| 2003/0198908 | A1 | 10/2003 | Berthold et al. | |
| 2005/0208443 | A1 * | 9/2005 | Bachinski et al. | 431/8 |

OTHER PUBLICATIONS

International Search Report and Written Opinion for International Application No. PCT/US2010/028006, Mail Date Jun. 29, 2010, 11 pages.

* cited by examiner

*Primary Examiner* — Alfred Basichas
(74) *Attorney, Agent, or Firm* — Perkins Coie LLP

(57) ABSTRACT

A fireplace assembly with an integrated burn control system includes a variety of features that provide an elegant, revolutionary, and highly-efficient way to heat a residence or other environment. The fireplace assembly may be used in combination with gas-burning fireplaces, stoves, and fireplace inserts. The fireplace assembly includes, but is not limited to: a control panel; a concealment door that conceals the control panel when the concealment door is closed; automatic control panel lighting that is activated when the concealment door is open; a split flow or dual burner assembly that simulates a natural wood burning fire; and an intermittent pilot ignition system that allows a pilot flame to run continuously or intermittently. The fireplace assembly can be manually controlled via the control panel or automatically and/or remotely controlled via a remote control device.

20 Claims, 8 Drawing Sheets

FIREPLACE ASSEMBLY WITH INTEGRATED BURN CONTROL SYSTEM

CROSS REFERENCE TO RELATED APPLICATIONS

This application is a non-provisional patent application that hereby claims priority to and incorporates by reference in its entirety U.S. Provisional Patent Application No. 61/161,703, titled FIREPLACE ASSEMBLY WITH IMPROVED VALVE SYSTEM, and filed Mar. 19, 2009.

TECHNICAL FIELD

The present invention is directed to fireplace/stove assemblies, and, more particularly, fireplaces, fireplace inserts, and stoves.

SUMMARY

The present invention overcomes drawbacks experienced in the prior art and provides other benefits. A brief summary of some embodiments and aspects of the invention are presented. Thereafter, a detailed description of the illustrated embodiments is presented, which will permit one skilled in the relevant art to understand, make, and use aspects of the invention. One skilled in the art can obtain a full appreciation of aspects of the invention from the subsequent detailed description, read together with the figures, and from the claims, which follow the detailed description.

In accordance with at least one embodiment of the invention, a fireplace assembly comprises a fireplace assembly, comprising a control area having a control panel with a plurality of controls, and a concealment door movable between closed and open positions. The concealment door at least substantially blocks the control panel from view when the concealment door is in the closed position, and the concealment door reveals at least a portion of the control panel when the concealment door is in the open position. A light source is coupled to the concealment door and is activated to illuminate at least a portion of the control panel when the concealment door is in the open position. The light source is deactivated when the concealment door is in the closed position. A burner assembly is operatively coupled to the control panel. The burner assembly comprises a plurality of independent burner portions, and a fuel control valve configured to receive a flow of fuel from a fuel delivery line. The fuel control valve is configured to direct a first portion of the flow of fuel to a first burner portion and a second portion of the flow of fuel to a second burner portion. The fuel control valve is coupled to at least one of the plurality of controls. The control is configured to regulate the flow of fuel to at least one of the plurality of burner portions. A pilot flame assembly is alternately operable in a standing mode or an intermittent mode. The pilot flame assembly is configured to be continually on during the standing mode. The pilot flame assembly is further configured to be intermittently activated during the intermittent mode.

In another embodiment, a fireplace assembly, including fireplace installations, fireplace inserts, and/or stoves, comprises a burner assembly comprising multiple independent burners each configured to provide flames that simulates a natural wood-burning fire, and a fuel control valve coupled to the multiple independent burners. The fuel control valve is configured to direct a first portion of the flow of fuel to a first burner and a second portion of the flow of fuel to a second burner adjacent to the first burner. A control panel is coupled to the burner assembly. The control panel comprises a comfort control switch coupled to the fuel control valve and configured to regulate the flow of fuel to the second burner to turn the second burner or burner chamber on and off while the first burner remains on. A flame adjust control is coupled to the fuel control valve. The flame adjust control configured to regulate the flow of fuel to each burner that is turned on.

In yet another embodiment, a fireplace assembly comprises a plurality of burners, each burner configured to produce a flame that simulates a natural wood-burning fire and has a substantial continual flame appearance when gas burns adjacent to an upper surface of the burner. A gas control valve is coupled to the plurality of burners. The gas control valve is configured to receive a flow of gas from a gas delivery line, to direct a first portion of the flow of gas to a first burner, and to direct a second portion of the flow of gas to a second burner generally adjacent to the first burner. A control area has a control panel with a plurality of controls therein. The plurality of controls includes a comfort switch coupled to the gas control valve. The comfort switch is configured to turn one of the plurality of burners on and off. The plurality of controls also includes a flame control coupled to the gas control valve. The flame control is configured to adjust the flow of gas to each burner that is turned on.

DETAILED DESCRIPTION

A fireplace assembly with an integrated burn control system is described in detail herein in accordance with embodiments and aspects of the present invention. In one embodiment, the fireplace assembly includes a full suite of features that provide an elegant, revolutionary, and highly-efficient way to heat the home. The burn control system can include a control panel, a concealment door, automatic control panel lighting, a dual burner assembly, an intermittent pilot ignition (IPI) system, and a remote control unit.

The fireplace assembly and/or burn control system described herein may be used in combination with fireplaces, stoves, and fireplace inserts, including gas-burning fireplaces, stoves, and fireplace inserts. In the following description, numerous specific details are discussed to provide a thorough and enabling description for embodiments of the disclosure. One skilled in the relevant art, however, will recognize that the disclosure can be practiced without one or more of the specific details. In other instances, well-known structures or operations are not shown, or are not described in detail, to avoid obscuring aspects of the disclosure. In general, alternatives and alternate embodiments described herein are substantially similar to the previously described embodiments, and common elements are identified by the same reference numbers.

Figure 1:
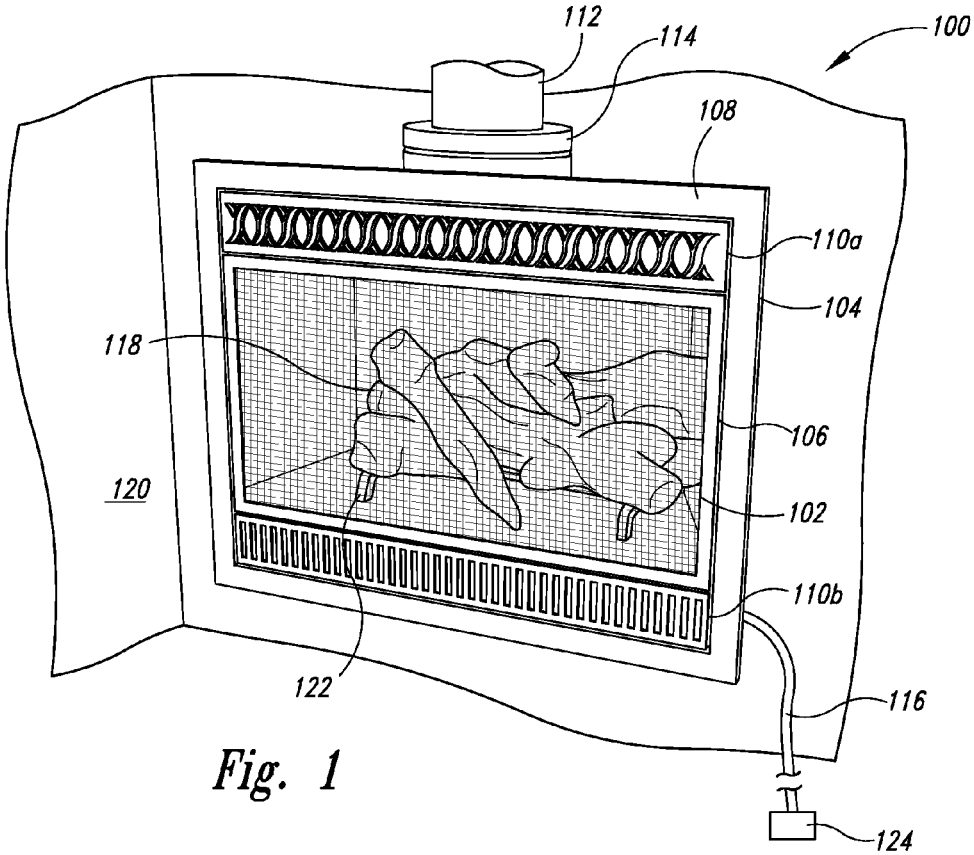
FIG. 1 is a front isometric view of a fireplace assembly in accordance with an embodiment of the present invention.

FIG. 1 is an isometric view of a fireplace assembly 100 in accordance with an embodiment of the disclosure. The illustrated fireplace assembly 100 is a gas-burning, direct vent fireplace coupled to a fuel source 124. The fireplace assembly 100 receives a fuel delivery line 116, which carries fuel from the fuel source 124 to a burner assembly 122 in the fireplace assembly. The fuel delivery line 116 can be coupled to the fireplace assembly 100 in a variety of locations. The fireplace assembly 100 is configured to provide heat into the room 120 in which the fireplace assembly is located when the fireplace assembly is activated.

The fireplace assembly 100 includes a direct vent chimney 112 that extends from the fireplace assembly. The direct vent chimney 112 is sealably connected to a flue adapter 114 on the top or back of the fireplace assembly 100. In an alternative embodiment, two separate, non-concentric flues (e.g., an exhaust flue and an air intake flue) may be connected to the top or back of the fireplace assembly 100. In the illustrated embodiment, the direct vent chimney 112 extends out the top of the fireplace assembly 100, although alternate embodiments can have the direct vent chimney extending out the back or side of the fireplace assembly.

The illustrated fireplace assembly 100 has an outer housing 104 with an inner housing that contains a firebox 102. The firebox 102 is spaced apart from the outer housing 104 to define heat exchange passageways between the firebox and the outer housing. The heat exchange passageways are adapted to direct a flow of air around the firebox 102 so a flow of air moving from the room 120 through the fireplace assembly 100 is heated before the air is blown out of the fireplace assembly back into the room. The fireplace assembly 100 can include a convection blower coupled to the heat exchange passageways to facilitate the flow of air through the fireplace assembly.

The firebox 102 contains a burner assembly 122, such as the Dancing-Fyre® burner assembly or the Ember-Fyre® burner assembly manufactured by Travis Industries, Inc. of Kirkland, Wash. The illustrated burner assembly 122 supports simulated logs 118 and simulates a real wood burning fire. The burner assembly 122 is operatively connected to a control system that can, inter alia, control the flow of fuel from the fuel source 124 to the burner assembly 122 for ignition and/or combustion adjacent to the surface of the burner assembly and the simulated legs.

The front of the firebox 102 is open to provide visibility and/or access into the firebox 102, such as for access to and/or maintenance of the burner assembly 122, as described in additional detail herein. The open front of the firebox 102 is sealably covered by a front panel 106, glass, or the like, which allows for viewing into the firebox. In addition, the fireplace assembly 100 has a decorative fireplace frame 108 mounted to the front side of the outer housing 104. The fireplace frame 108 may include one or more decorative faceplate grills 110 (identified individually as first decorative faceplate grill 110*a* and second decorative faceplate grill 110*b*). One or more of the decorative faceplate grills 110 is removable to expose aspects of the control system mounted in the outer housing 104. For example, in the illustrated fireplace assembly 100, decorative faceplate grill 110*b* is removable or openable to provide access to the control area and a control panel therein conveniently mounted in the outer housing 104 below the firebox 102. In the illustrated embodiment, a concealment door is provided behind the faceplate grill and positioned to conceal the control panel.

Concealment Door

Figure 2:
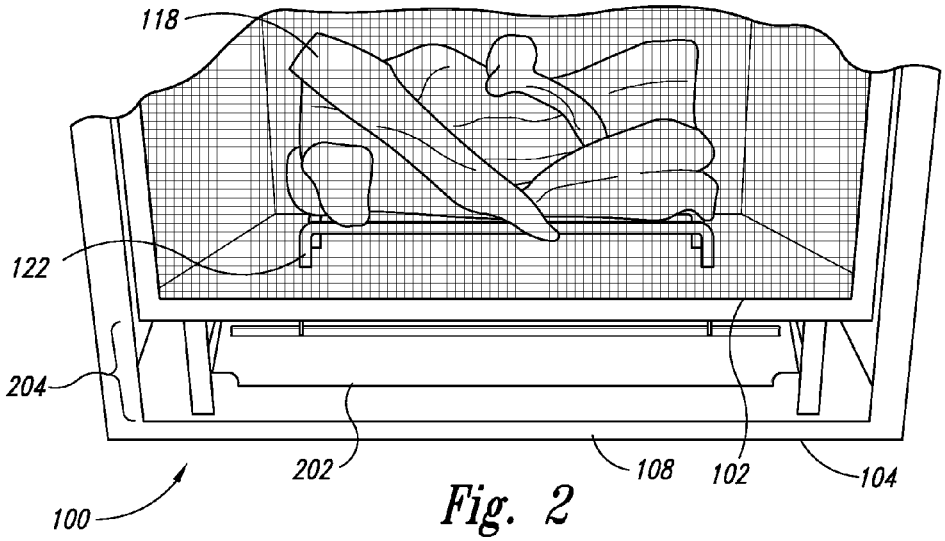
FIG. 2 is an enlarged front view of the fireplace assembly of FIG. 1 with a control area concealed by a concealment door.

FIG. 2 is an enlarged front view of the fireplace assembly of FIG. 1 showing a control area 204 within the outer housing 104 and below the firebox 102. In some embodiments, this control area 204 can be covered or partially covered with a decorative faceplate grill 110 (FIG. 1). The faceplate grill 110, which can be solid or partially latticed or cut away, can be fully removable pivotally hinged, or the like to allow access to the control area 204 (FIG. 2). The control area 204 includes a plurality of controls and a control panel (not shown) that are concealed by a moveable concealment door 202. The concealment door 202 is configured to conveniently open for easy access to the control area 204, for example, if manual adjustments are needed.

Figure 3:
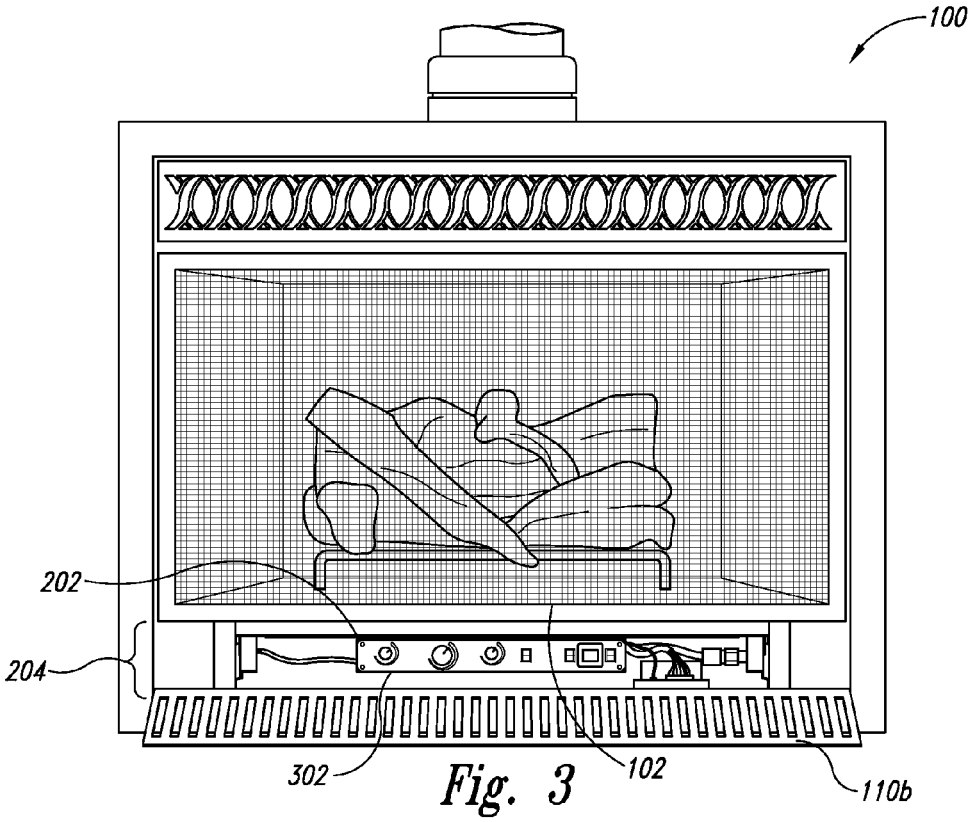
FIG. 3 is a front view of the fireplace assembly of FIG. 2 with the concealment door open and a control panel revealed.

FIG. 3 is a front view of the fireplace assembly of FIG. 2 with the concealment door 202 open and a control panel 302 revealed. The concealment door 202 is manually movable between the closed position (FIG. 2) and an open position (FIG. 3). In the open position, the concealment door 202 is positioned generally horizontally in a space under the firebox 102 and near the top of the control area 204, so as to expose the control panel 302. In the illustrated embodiment, the concealment door 202 is manually moveable between the open and closed positions, although in other embodiments the concealment door can be moved automatically or with the aid of a mechanical assist configuration (e.g., a spring assist device, a hydraulic assist device, a pneumatic assist device, etc.).

Figure 4:
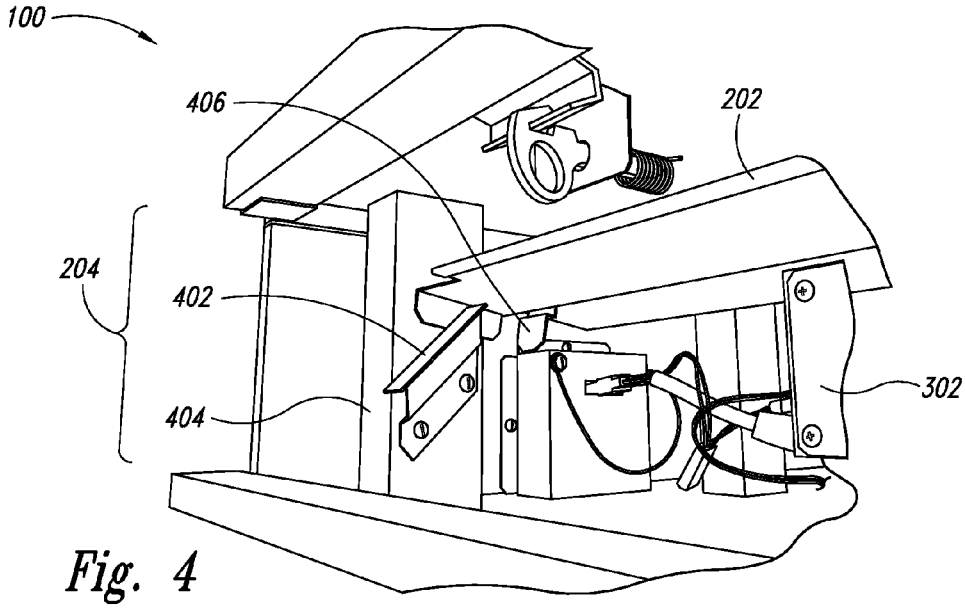
FIG. 4 is an enlarged isometric view of a side portion of the concealment door of FIG. 3 in the open position.

FIG. 4 is an enlarged isometric view of a side portion of the concealment door 202 of FIG. 3 in the open position. In the illustrated embodiment, the concealment door 202 is carried by tracks 402 mounted on supports 404 (only one track and support shown) coupled to the outer housing 104 (FIG. 1). The concealment door 202 rests atop the tracks 402 to expose the control panel 302 when in the open position, and the concealment door can slide or otherwise move along the tracks to the closed position. In another embodiment, the concealment door 202 can be mounted on one or more hinges and configured to pivot about the hinges between the open and closed positions.

In the illustrated embodiment, gravity causes the concealment door 202 to stay open as the concealment door rests atop the tracks 402. Similarly, gravity causes the concealment door 202 to stay closed as engagement members or projections 406 (only one engagement member or projection is shown) coupled to the concealment door engage upper edges of the tracks 402. In other embodiments, the concealment door 202 can be configured to stay open and/or closed via a latch or other suitable mechanism.

Automatic Control Panel Lighting

Figure 5:
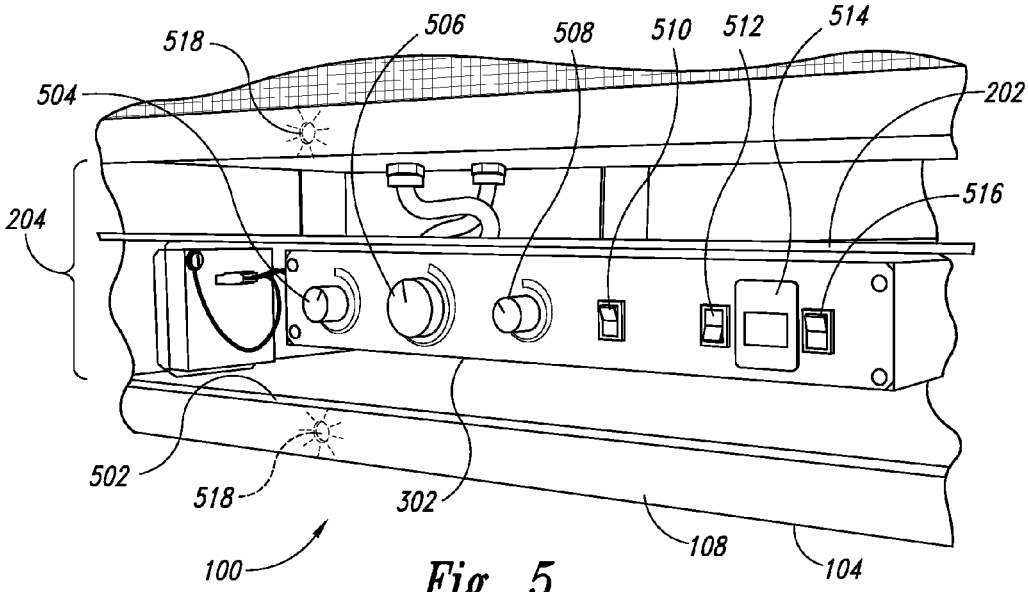
FIG. 5 is an enlarged front isometric view of the control panel of FIG. 3.

FIG. 5 is an enlarged front isometric view of the control panel 302 of FIG. 3. In the illustrated embodiment, the fireplace assembly 100 includes control panel lighting 502 with one or more lights 518 positioned in the control area 204 generally above and forward of the controls. The lights 518 in other embodiments can be in other positions, such as below the controls, so as to adequately illuminate the control panel for use by a user. The lights 518 are coupled to the concealment door 202 such that when the concealment door is in the open position, the lights 518 are automatically turned on to improve viewing of the control panel 302, especially in a low light environment.

In the illustrated embodiment, the control panel lighting 502 is mounted in the outer housing 104, adjacent to the decorative frame 108. The control panel lighting 502 has one or more lights 518 positioned to illuminate the control panel 302 for improved viewing and readability. In one embodiment, the lights 518 include one or more light-emitting diodes (LEDs), although other embodiments can use incandescent or other lights to illuminate the control panel 302 when the concealment door 202 is open.

Figure 6:
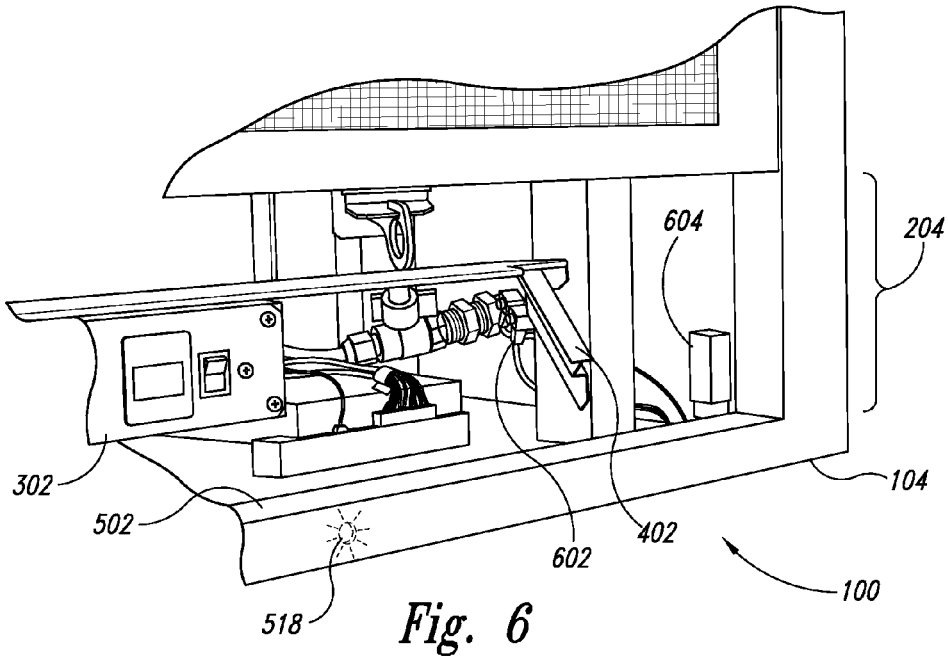
FIG. 6 is an enlarged front isometric view of the control area of FIG. 2.

FIG. 6 is an enlarged front isometric view of the control area 204 of FIG. 2. The lights 518 are operatively coupled to a switch 602 positioned to be engaged by the concealment door 202 when the concealment door is in one of the open or closed positions. In the illustrated embodiment, the switch 602 is a pressure sensitive, spring-loaded switch positioned next to one of the tracks 402, so that the concealment door 202 engages the switch and retains it in the off position when the concealment door is in the closed position. Accordingly, the lights 518 are off when the concealment door 202 is closed. When the concealment door 202 is moved away from the closed position, the concealment door disengages the switch 602, the switch automatically moves to the "on" position, and the lights 518 are turned on. In other embodiments, other switch configurations can be used.

In some embodiments, the lights 518 are operatively coupled to one or more batteries 604 to provide back-up power if the main power to the fireplace assembly 100 is interrupted. In the illustrated embodiment, the batteries 604 are mounted in the outer housing 104. Accordingly, the batteries 604 are easy to access, such as to replace and/or charge the batteries if needed.

Burner Assembly

As best seen in FIG. 2, the firebox 102 contains a burner assembly 122, such as the Dancing-Fyre® burner assembly or the Ember-Fyre® burner assembly manufactured by Travis Industries Inc. of Kirkland, Wash. The Ember-Fyre® burner assembly is described in additional detail in commonly owned U.S. Pat. Nos. 6,443,726 and 6,602,068, which are incorporated by reference herein.

As best seen in FIG. 1, in the illustrated embodiment, the burner assembly 122 is coupled to a fuel source 124 via one or more fuel delivery lines 116 that carry the fuel, e.g., natural gas, propane, etc., to the burner assembly for ignition. The burner assembly 122 is positioned in the bottom of the firebox 102. In the illustrated embodiment, a plurality of simulated logs 118 and/or a coal bed are positioned in the firebox 102 atop the burner assembly 122. Accordingly, when the fuel passing through the burner assembly 122 is ignited and burned, the flames are located around or adjacent to the simulated logs 118 and/or coal bed in a manner that very closely resembles a fire in a natural wood burning fire.

The burner assembly 122 of the illustrated embodiment is a split flow or dual burner assembly. In some embodiments, the burner assembly 122 comprises two or more separate burners, while in other embodiments the burner assembly comprises a single burner with multiple chambers that share a common top plate. In the illustrated embodiment, the burner assembly 122 includes two independent burner portions, a front burner portion and a rear burner portion. Alternate embodiments, however, may include one burner or more than two burners.

Figure 7:
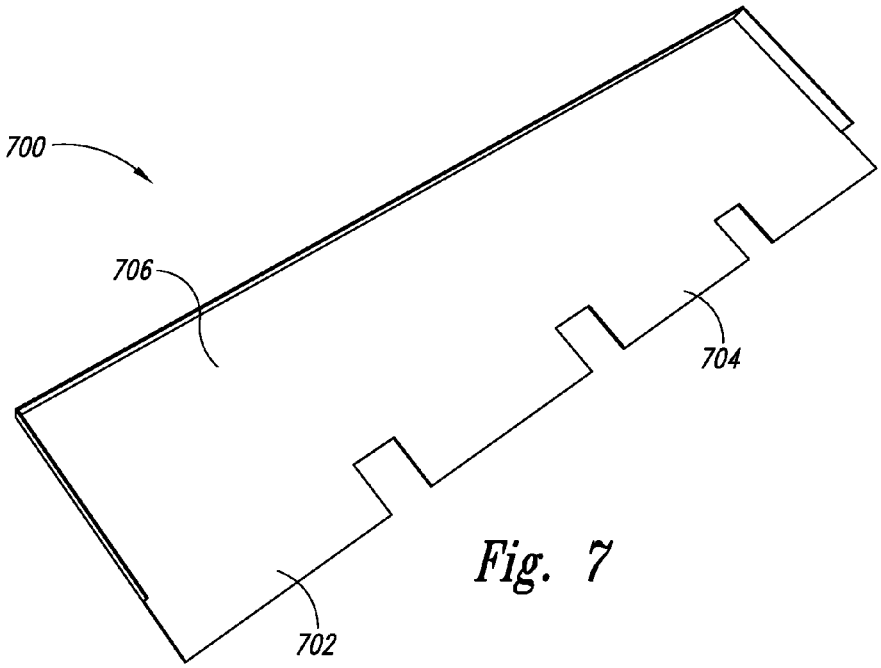
FIG. 7 is a top isometric view of a dual burner assembly shown removed from the fireplace of FIG. 1.

FIG. 7 is a top isometric view of a burner 700 of a dual burner assembly 122 shown removed from the fireplace assembly 100 of FIG. 1. The illustrated burner 700 has a substantially flat metallic body 702 that forms the upper portion of the burner assembly 122. In other embodiments, the burner 700 has a non-metallic body, such as a body made from a ceramic-based material or the like. Alternatively or additionally, the body 702 may have a contoured upper surface molded to form a plurality of simulated coals or embers. In the illustrated embodiment, the burner 700 is configured to distribute the fuel at selected rates and volumes over a generally flat upper surface 704 and around the simulated logs 118 (FIG. 1) to provide a flame having a generally yellow or orange coloration that flickers and "dances" around the simulated logs, similar to the flames of a natural wood-burning fire.

Figure 8:
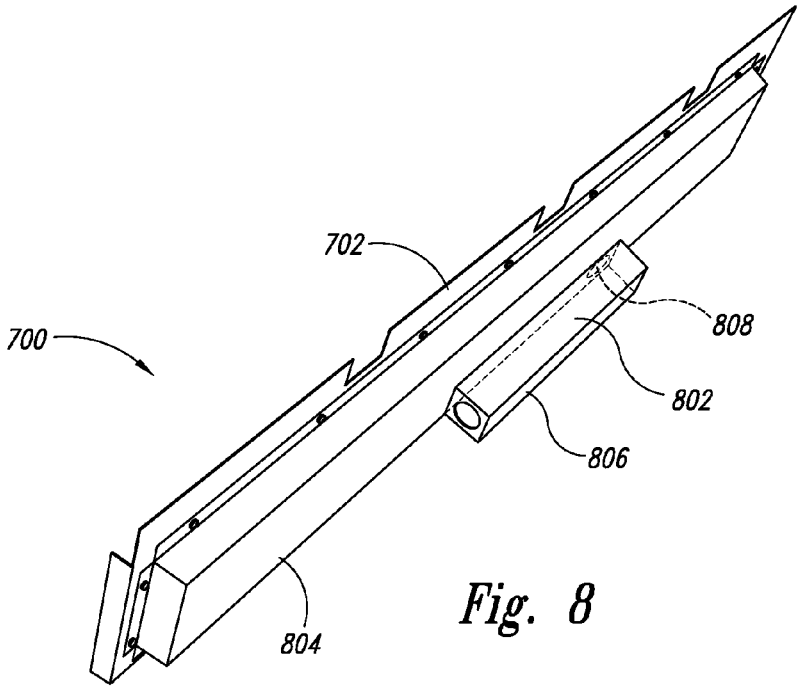
FIG. 8 is a rear isometric view of the dual burner assembly of FIG. 7 showing the burner's mixing chamber.

FIG. 8 is a rear isometric view of the burner 700 of the dual burner assembly 122 of FIG. 7 showing the burner's mixing tube assembly 802. The burner 700 includes a burner pan 804 connected to the bottom of the burner body 702. The burner 700 connects to the fuel delivery line 116 (FIG. 1) with a mixing tube assembly 802 connected to the bottom of the burner pan 804. Accordingly, the fuel is provided via the fuel delivery line 116 (FIG. 1) through the mixing tube assembly 802 to the burner body 702. The burner body 702 has an interior chamber that receives the fuel from the mixing tube assembly 802. The interior chamber forms an integral fuel distribution manifold that directs the fuel through the burner body 702 to the burner body's upper surface 704 (FIG. 7) for ignition into a flame. The burner pan 804, when installed on the burner body 702, extends over the interior chamber so as to close out the interior chamber's lower side, and to allow access to the interior chamber when the burner pan is removed from the burner body.

The burner pan 804 is a substantially flat metal plate having a fuel inlet aperture 808, and the mixing tube assembly 802 connects to the burner pan at the fuel inlet aperture 808. The mixing tube assembly 802 includes a horizontal mixing tube 806 connected at one end to the fuel inlet aperture 808 and at the other end to the fuel delivery line 116 (FIG. 1). The mixing tube assembly 802 is configured to allow a selected amount of air to mix with the fuel in a conventional manner before the mixture passes through the fuel inlet aperture 808 and into the interior chamber of the burner body 702.

As best seen in FIG. 7, the interior chamber of the burner body 702 communicates with a plurality of burner apertures 706 extending through the top portion of the burner body. The interior chamber is positioned relative to the fuel inlet aperture 808 of the burner pan 804 (FIG. 8), to selectively maintain a desired fuel pressure in the interior chamber for a desired flow of the fuel through the burner apertures 706.

The burner apertures 706 extend through the burner body 702 and provide a fuel passageway from the interior chamber to the upper surface 704 of the burner assembly 122 (FIG. 1). The burner apertures 706 have openings in the upper surface 704 and distribute the fuel to different portions of the upper surface 704 for combustion. The burner apertures 706 are sized and positioned to provide the fuel to selected areas of the upper surface 704 of the burner body 702 to create a selected flame pattern when the burner 700 is in use. The burner apertures 706 are positioned relative to each other so that some burner apertures are grouped closer together and some burner apertures are more spread out from each other. This positioning of the burner apertures 706 helps control the distribution of the fuel at the upper surface 704, thereby controlling the flame characteristics from the burner 700.

The burner apertures 706 also have selected diameters to control the volume and velocity of the fuel exiting the apertures at the upper surface 704, thereby also controlling the fuel distribution and resulting flame characteristics when the burner 700 is in use. In some embodiments, the burner apertures 706 have diameters of approximately ⅛ inch thick. Other embodiments, however, can have burner apertures 706 with diameters larger or smaller than ⅛ inch thick. Alternatively or additionally, the burner apertures 706 may have different heights.

Figure 9:
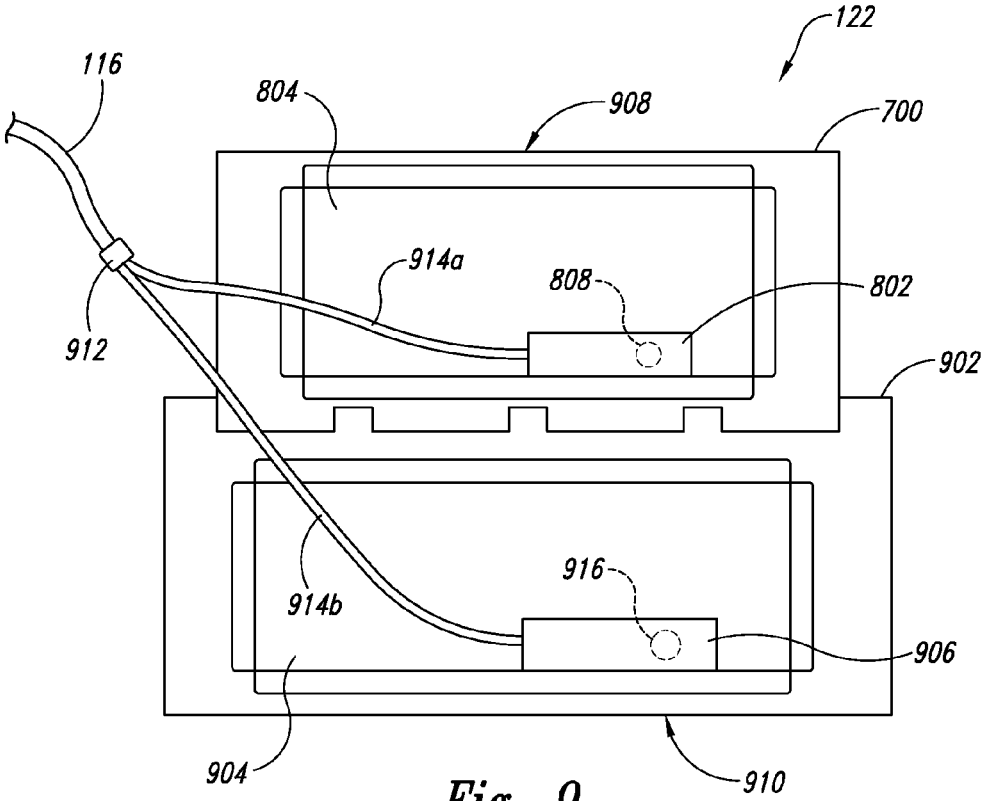
FIG. 9 is a rear perspective view of the dual burner assembly shown removed from the fireplace of FIG. 1.

FIG. 9 is a rear perspective view of a dual burner assembly 122 shown removed from the fireplace assembly 100 of FIG. 1. The burner assembly 122 has a front side 908 shown closer to the top of the drawing page, and a rear side 910 shown closer to the bottom of the drawing page. The burner assembly 122 comprises a front burner portion 700 (FIG. 7) and a rear burner portion 902. The front and rear burner portions 700 and 902 are sealed and isolated from each other so that the gas from one of the burner portion does not flow to the other burner portion. Accordingly, each of the front and rear portions act substantially as an independent burner. In the illustrated embodiment, the front burner portion 700 has a burner pan 804 and a mixing tube assembly 802, which is connected to the burner pan at a fuel inlet aperture 808. The rear burner portion 902 has a burner pan 904 and a mixing tube assembly 906, which is connected to the burner pan at a fuel inlet aperture 916. Accordingly, the fuel is provided into the burner assembly 122 through these two fuel inlet apertures 808 and 916.

In the illustrated embodiment, a fuel control valve 912 coupled to the fuel delivery line 116 regulates the flow of fuel to each of the multiple burner portions 700 and 902. That is, the fuel control valve 912 is configured to split the flow of fuel, delivering a portion of the flow of fuel to the front burner 700 and a portion of the flow of fuel to the back burner 902. In some embodiments, the flow of fuel is delivered to each of the burner portion 700 and 902 via a secondary fuel delivery line 914 (identified individually as first secondary fuel delivery line 914*a* and second secondary fuel delivery line 914*b*). The percentage of the fuel flow that is delivered to each burner portion 700 and 902 is controlled by, for example, the size of an orifice or valve member leading to the secondary fuel delivery line 914, and thus to the burner.

Figure 10:
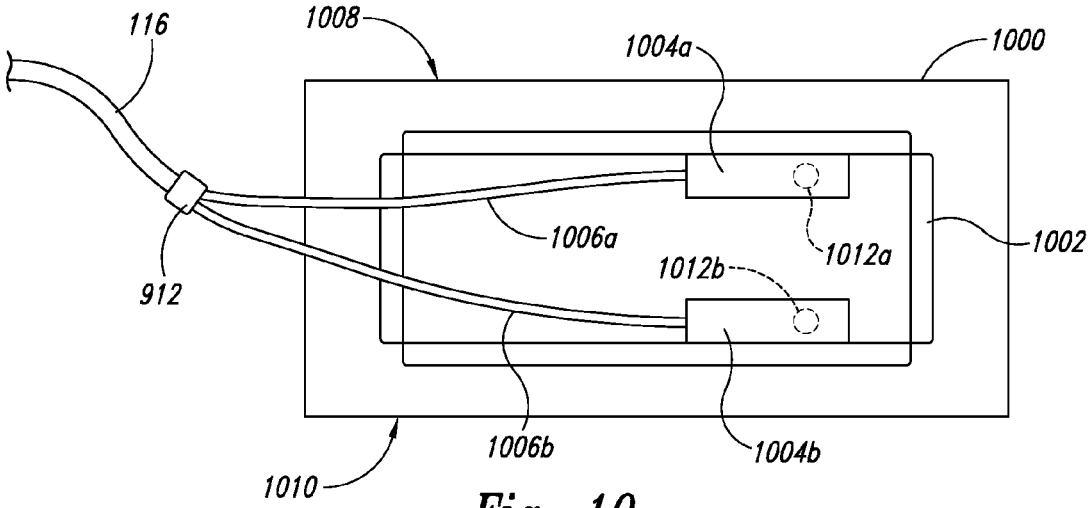
FIG. 10 is a rear perspective view of an alternative split flow burner assembly.

In other embodiments, the fuel control valve 912 regulates the flow of fuel to multiple chambers of a single burner. FIG. 10 is a rear perspective view of an alternative split flow burner assembly 1000. The burner assembly 1000 has a front side 1008 shown closer to the top of the drawing page, and a rear side 1010 shown closer to the bottom of the drawing page. The burner assembly 1000 includes a burner pan 1002 and multiple mixing tube assemblies 1004 (identified individually as first mixing tube assembly 1004*a* and second mixing tube assembly 1004*b*). Each of the mixing tube assemblies 1004 is connected to the burner pan 1002 at a fuel inlet aperture 1012 (identified individually as first fuel inlet aperture 1012*a* and second fuel inlet aperture 1012*b*).

In the illustrated embodiment, a fuel control valve 912 coupled to the fuel delivery line 116 regulates the flow of fuel to each of the mixing tube assemblies 1004. That is, the fuel control valve 912 splits the flow of fuel, delivering a portion of the flow of fuel to the first mixing tube assembly 1004*a* and a portion of the flow of fuel to the second mixing tube assembly 1004*b*. In some embodiments, the flow of fuel is delivered to each of the mixing tube assemblies 1004 via a secondary fuel delivery line 1006 (identified individually as first secondary fuel delivery line 1006*a* and second secondary fuel delivery line 1006*b*). In turn, each of the mixing tube assemblies 1004 provides fuel to a separate burner chamber, as described in additional detail herein.

Figure 11:
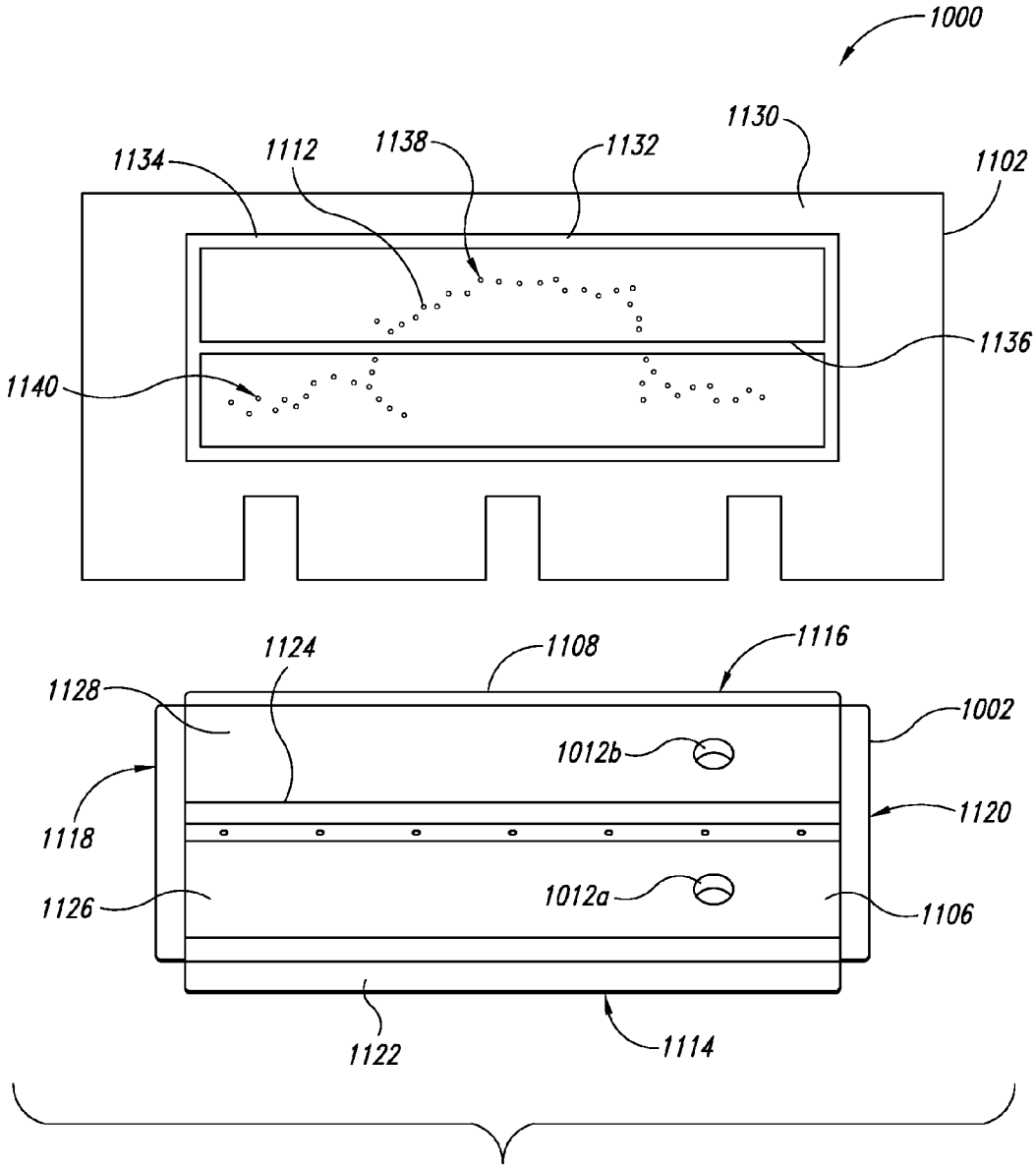
FIG. 11 a partially exploded perspective view of the alternative split flow burner assembly of FIG. 10.

FIG. 11 is a partially exploded perspective view of the alternative split flow burner assembly 1000 of FIG. 10. FIG. 11 depicts a burner body 1102 and a burner pan 1002, the burner body being shown rotated relative to the burner pan to simultaneously show the burner pan and a lower portion of the burner body. The burner body pan 1002, as oriented in FIG. 11, has a front side 1114 shown closer to the bottom of the drawing page, a rear side 1116 shown closer to the top of the drawing page, a left side 1118, and a right side 1120.

The burner pan 1002 has a shallow pan configuration formed by a base 1106 and a plurality of perimeter walls 1108 connected to the perimeter of the base and projecting upwardly away from the base. The base 1106 has a pair of fuel inlet apertures 1012 (identified individually as first fuel inlet aperture 1012*a* and second fuel inlet aperture 1012*b*) extending therethrough. The fuel inlet apertures 1012 are each connected to a mixing tube assembly 1004 (FIG. 10), which is coupled to a fuel source. For example, fuel inlet aperture 1012*a* is connected to mixing tube assembly 1004*a* (FIG. 10), and fuel inlet aperture 1012*b* is connected to mixing tube assembly 1004*b* (FIG. 10). Accordingly, the fuel is provided into the burner assembly 1000 through these two fuel inlet apertures 1012.

The illustrated perimeter walls 1108 form sidewalls that are integrally connected to the base 1106. The burner pan 1002 also has one or more internal chamber fences 1124 connected to the base 1106. In alternate embodiments, the perimeter walls 1108 and internal chamber walls 1124 can be separate structures securely attached to the base 1106. The base 1106 the perimeter walls 1108 and the internal chamber walls 1124 are configured such that, when the burner body 1102 is positioned on the burner pan 1002, multiple interior fuel distribution chambers receive fuel through the fuel inlet apertures 1110 and provide the fuel to the burner body's upper surface through burner apertures 1112 extending through the burner body 1102. In other embodiments, the perimeter walls and/or the internal chamber walls can be attached to or formed in the burner body and configured to interface with the burner pan to firm the multiple, independent chambers.

The burner pan 1002 has side support plates 1122 projecting outwardly away from the perimeter fences 1108. The support plates 1122 are positioned to engage and support the lower portion of the burner body 1102 when the burner body is joined with the burner pan 1002 to help support the burner body. The front chamber portion 1126 is in fluid communication with the front fuel inlet aperture 1012*a* such that fuel flowing therethrough will flow into the front chamber portion. The rear chamber portion 1128 is in fluid communication with the rear fuel inlet aperture 1012*b* such that fuel flowing therethrough will flow into the rear chamber portion. The internal chamber wall 1124 is positioned to block the fuel from flowing forwardly out of the rear chamber portion 1128 when the burner body 1102 is attached to the burner pan 1002.

The burner apertures 1112 in the illustrated embodiment are arranged to provide a forward aperture set 1138 that communicates directly with the front chamber portion 1126. The fuel provided into the front chamber portion 1126 is distributed through the chamber portion and flows through the burner apertures 1112 in this forward aperture set 1138 to the burner body's upper surface for ignition. The burner apertures 1112 are also configured to provide a rear aperture set 1140 in fluid communication with the rear chamber portion

1128. The fuel from the rear chamber portion 1128 flows through the burner apertures 1112 in this rear aperture set 1140 to the burner body's upper surface for ignition.

When the burner pan 1002 is mounted on the burner body 1102, the burner pan 1002 seals against the lower portion 1130 of the burner body. This sealed engagement prevents cross flow or leakage of the fuel between the front and rear chamber portions 1126 and 1128.

Control System

As best seen in FIG. 5, the burner assembly 122 is operatively coupled to a control system that, inter alia, controls the flow of fuel from the fuel source 124 (FIG. 1) to the burner assembly 122 for combustion adjacent to the surface of the burner assembly. In the illustrated embodiment, the control system includes a control panel 302 comprising various controls and features, including, but not limited to, a blower control 504, an accent light control 506, a flame adjust control 508, a pilot switch 510, a comfort control switch 512, a battery tray 514, and a main burner switch 516. The controls are labeled in a manner that makes them highly visible, such as in a high-contrast manner. In the illustrated embodiment, the controls are labeled with white silkscreened lettering on a black control panel 302. In combination with the automatic control panel lighting described herein, the controls are easy to view, even in a low light environment.

In some embodiments, the fireplace assembly 100 includes a convection blower coupled to the heat exchange passageways to facilitate the flow of air through the fireplace assembly. In such embodiments, the blower is operatively coupled to an optional blower control 504. The blower control 504 can be turned to an "OFF" position to shut the blower off completely, or the control can be positioned between different settings, such as "LOW" and "HIGH" settings, to adjust the speed of the blower.

In some embodiments, the fireplace assembly 100 includes accent lights in the firebox 102. The accent lights can be positioned in various locations within the firebox 102, and provide a warm glow to the simulated logs 118 and interior of the firebox when the accent lights are on. The accent lights can be used whether or not a fire is currently burning in the firebox 102. For example, the accent lights can be used without a fire in order to provide a night light or soft indirect light for the room 120. The accent lights are operatively coupled to an accent light control 506. The accent light control 506 can be turned to an "OFF" position to turn off the accent lights, or the control can be rotated between different settings, such as "LOW" and "HIGH" settings, to adjust the brightness of the accent lights.

A comfort control switch 512 can be used to turn one or more burners of the burner assembly 122 on and off. In the illustrated embodiment, the comfort control switch 512 toggles the rear burner 902 (FIG. 9) on and off. The comfort control switch 512 is operatively coupled to the fuel control valve 912 (FIG. 9) to control the flow of fuel to the rear burner 902. When the comfort control switch 512 is depressed in the "ON" position, the fuel control valve 912 closes the secondary fuel delivery line 914*b* (FIG. 9), turning the rear burner 902 off. Accordingly, flames are provided from only the front portion of the burner assembly, thereby resulting in a smaller or reduced fire or flame set. When the comfort control switch 512 is depressed in the "OFF" position, the fuel control valve 912 permits fuel to flow through the secondary fuel delivery line 914*b*, turning the rear burner 902 on. Accordingly, both the front and rear burners are operational and flames are provided from the front and rear portions of the burner assembly. While the illustrated embodiment depicts a single comfort control 512, alternative embodiments have multiple comfort controls. For example, one alternative embodiment may have a comfort control 512 associated with each burner or burner chamber of the burner assembly 122. Alternatively, the comfort control can be coupled to the front burner, so as to turn the front burner on or off while the rear burner continues to burn.

In the illustrated embodiment, when the rear burner 902 (FIG. 9) is turned off (e.g., by turning the comfort control switch "ON") there is a greater than fifty-percent reduction in the BTU output from the burner assembly 122. In some embodiments, the reduction in BTU is approximately 70 percent, although alternative embodiments have different reductions in BTU. As a result of the reduction in BTU output, there is a reduction in heat output by the fireplace assembly 100 into the room 120.

A flame adjust control 508 regulates the flow of fuel to one or more burners of the burner assembly 122. In the illustrated embodiment, the flame adjust control 508 is also operatively coupled to the fuel control valve 912 (FIG. 9) to regulate the flow of fuel to each burner that is turned on. The flame adjust control 508 can be positioned between different settings, such as "LOW" and "HIGH" settings, to adjust the flow of fuel to the burners, and thus the height of the flames generated by one or both of the burners. In the illustrated embodiment, when the comfort control 512 is "ON," the fuel control valve 912 regulates the flow of fuel to the front burner 700 (FIG. 9) only, as the rear burner 902 is turned off. When the comfort control 512 is "OFF," the fuel control valve 912 regulates the flow of fuel to both the front and rear burners 700 and 902 (FIG. 9). The size of the resulting flames in either the "ON" or "OFF" position can be controlled by selecting the "LOW" or "HIGH" settings.

When the comfort control 512 is "ON" and the flame adjust control 508 is turned to a relatively low setting, the fuel control valve 912 is engaged to reduce the flow of fuel to the front burner 700 (FIG. 9). Accordingly, a flame emitted from the front burner 700 will be relatively low. When the flame adjust control 508 is turned to a relatively high setting (and the comfort control 512 remains "ON"), the fuel control valve 912 is engaged to increase the flow of fuel to the front burner 700. Accordingly, the flame emitted from the front burner 700 will be relatively high. When the comfort control 512 is turned "OFF" and the flame adjust control 508 is turned to a relatively low setting, the fuel control valve is engaged to reduce the flow of fuel to both the front and rear burners 700 and 902 (FIG. 9). Accordingly, the flames emitted from the front and rear burners 700 and 902 will both be relatively low. When the flame adjust control 508 is turned to a relatively high setting (and the comfort control 512 remains "OFF"), the fuel control valve 912 is engaged to increase the flow of fuel to both the front and rear burners 700 and 902. Accordingly, the flames emitted from the front and rear burners 700 and 902 will both be relatively high. While the illustrated embodiment depicts a single flame adjust control 508, alternative embodiments have multiple flame adjust controls. For example, one alternative embodiment may have a flame adjust control 508 associated with each burner 700 and 902 or burner chamber of the burner assembly 122.

A pilot switch 510 toggles the fireplace assembly 100 between a standing pilot mode and an intermittent pilot ignition (IPI) mode. Depressing the pilot switch 510 toward the "Continuous Pilot" indication activates the standing pilot mode. In standing pilot mode, a pilot flame of the fireplace assembly 100 continually stays on. Standing pilot mode is preferable, for example, during periods of extreme cold when a draft is needed for safe, proper fireplace operation. Alternatively, depressing the pilot switch 510 toward the "GreenSmart® Pilot" indication activates the IPI mode. In the IPI mode, the pilot flame does not run continually; instead, the pilot flame is only on when it is manually or automatically turned on, as described in additional detail herein. The IPI mode conserves energy when the fireplace is not being operated.

When the IPI mode is active, the pilot flame is toggled on and off using a main burner switch 516. When the main burner switch 516 is depressed in the "ON" position, the pilot flame is turned on; when the main burner switch is depressed in the "OFF" position, the pilot flame is turned off. In the illustrated embodiment, the pilot flame is turned on using an electronic ignition. Alternative embodiments may use other types of ignitions.

Figure 14:
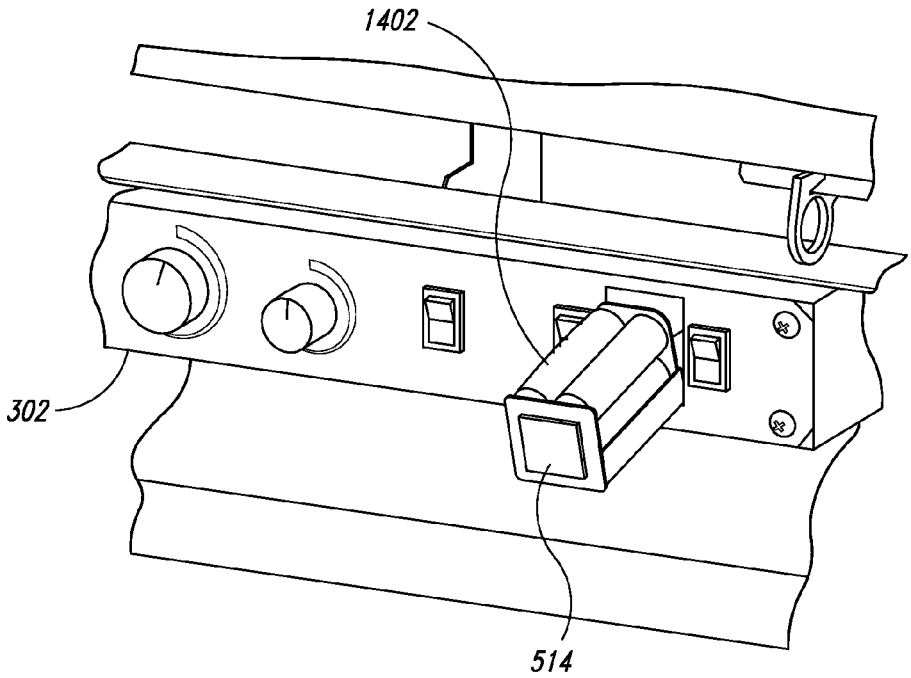
FIG. 14 is an enlarged front isometric view of the control panel of FIG. 5, with a back-up battery tray shown in an open position.

The IPI mode includes a battery back-up, ensuring ignition of the pilot flame even during power outages. As best seen in FIG. 5, in the illustrated embodiment, the back-up batteries are stored in a battery tray 514 contained in the control panel 302. Among other benefits, such a battery tray 514 provides organized storage of and easy access to the batteries housed therein. FIG. 14 is an enlarged front isometric view of the control panel of FIG. 5, with the battery tray 514 shown in an open position. The battery tray 514 pulls out from the control panel 302 to expose the batteries 1402 housed therein. Accordingly, the batteries 1402 can be easily replaced and/or charged as needed.

Figure 12:
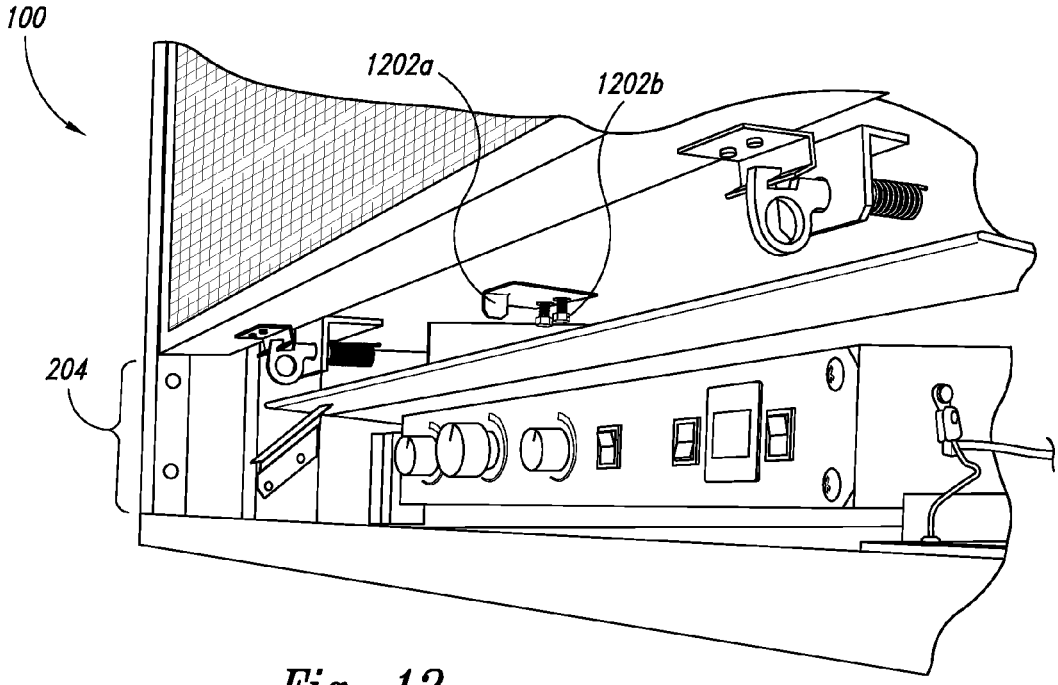
FIG. 12 is an enlarged isometric view of the control area of FIG. 3 showing air shutter adjustments.

FIG. 12 is an enlarged isometric view of the control area 204 of FIG. 3 showing air shutter adjustments 1202. In the illustrated embodiment, the air shutter adjustments 1202 (identified individually as first air shutter adjustment 1202*a* and second air shutter adjustment 1202*b*) are operatively connected to the front and rear burners of the burner assembly 122, and can be used to adjust the air flow that enters the mixing tube assemblies and/or the gas distribution chambers. The air shutter adjustments 1202 are mounted to the firebox 102, such as on the underside of the firebox. The air shutter adjustments 1202 are positioned in the control area 204 and are easily accessible from the front of the fireplace assembly 100 while the fire is burning. Accordingly, the air shutter adjustments 1202 are user-friendly and allow adjustments to be made to the air flow while the burner assembly 122 is in operation. This is a significant improvement over prior systems that require making a first guess at proper air flow and, if the guess proves to be unsatisfactory, shutting down the burner assembly 122 and waiting for it to cool down before making a second guess at proper air flow.

Each burner or burner chamber can have its own air shutter adjustment 1202. In the illustrated embodiment, air flow to the front burner 700 (FIG. 9) is controlled by a first air shutter adjustment 1202*a*, while air flow to the rear burner 902 (FIG. 9) is controlled by a second air shutter adjustment 1202*b*. To adjust the air flow to the corresponding burner, the air shutter adjustment 1202 may be moved front-to-back, left-to-right, or the like. Altering the position of the air shutter adjustment 1202 modifies the air to fuel ratio in the mixing tube assembly 802 or 906 of the corresponding burner 700 or 902. In the illustrated embodiment, the air shutter adjustments 1202 are color-coded, so that the burner 700 or 902 or burner chamber associated with the air shutter adjustment can be readily identified. For example, in the illustrated embodiment, the air shutter adjustment 1202*a* that corresponds to the front burner 700 is one color, such as red, while the air shutter adjustment 1202*b* that corresponds to the rear burner 902 is a different color, such as yellow.

Remote Control Unit

Figure 13:
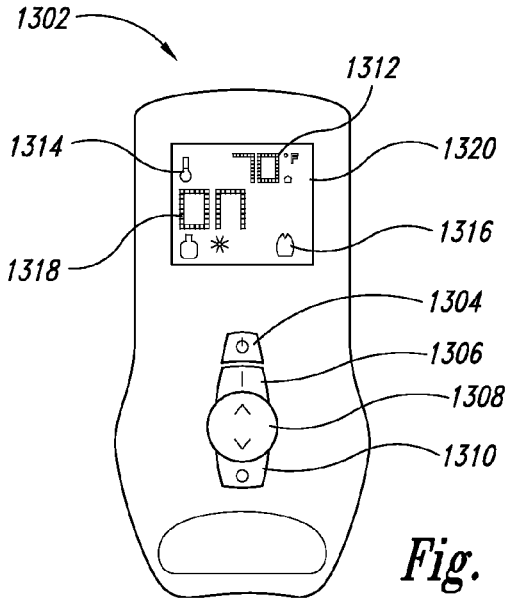
FIG. 13 is an isometric view of a remote control unit of the fireplace assembly of FIG. 1.

FIG. 13 is an isometric view of a remote control unit 1302 of the fireplace assembly 100 of FIG. 1. While the foregoing embodiments describe manual adjustments that may be made to various controls of the fireplace assembly 100, these controls can alternatively or additionally be adjusted automatically and/or remotely. In some embodiments, the controls of the fireplace assembly 100 are adjusted using a remote control unit 1302, such as one manufactured by SIT La Precisa, of Padova, Italy.

To utilize the remote control unit 1302, various additional hardware components are installed in the fireplace assembly 100, including, but not limited to, a receiver cartridge, a servo motor for the fuel control valve 912 (FIG. 9), and a power control module. The receiver cartridge is installed in the control panel 302 (FIG. 3) and is operatively coupled to the servo motor and the power control module.

Once the additional hardware components have been installed in the fireplace assembly 100, the remote control unit 1302 can be used to control various features of the fireplace assembly. In the illustrated embodiment, the remote control unit 1302 includes three selectable modes—a manual mode, a standard thermostat mode, and a smart thermostat mode. A user can scroll through these modes by pressing a thermostat button 1306. An icon 1314 on a display screen 1312 of the remote control unit 1302 reflects the selected mode.

In the manual mode, the user can manually turn the fire on and off by pressing a power button 1304. The remote control unit 1302, via the receiver cartridge, engages the power control module to turn the fire on and off. In addition, the manual mode allows the user to control a variety of fireplace assembly 100 features including, but not limited to, the blower, accent lights, flame height, burners, and other features. A user can scroll through these features by pressing a mode button 1310. As the user scrolls through the features, an icon in a lower area 1316 of the display screen 1312 is highlighted to reflect the selected feature. The selected feature can be manipulated using an UP/DOWN button 1308. For example, if the blower feature is selected, the user can press "UP" to turn the blower on, and "DOWN" to turn the blower off. In addition, once the blower is on, the user can press "UP" and/or "DOWN" one or more times to adjust the speed of the blower. The on/off status and/or the level (e.g., low, medium, high) associated with the feature is displayed in a middle area 1318 of the display area 1312.

To adjust the flame height, the user presses the mode button 1310 until a flame adjust icon is selected in the lower area 1316 of the display screen 1312. The user can press "UP" one or more times to increase the flame height, and can press "DOWN" one or more times to decrease the flame height. The remote control unit 1302, via the receiver cartridge, engages the servo motor coupled to the fuel control valve 912 (FIG. 9) to control the flow of fuel to the active burners 700 and/or 902 accordingly.

To turn one or more burners on and off, the user presses the mode button 1310 until a burner icon is selected in the lower area 1316 of the display screen 1312. In the illustrated embodiment, the user can use the remote control unit 1302 to turn the rear burner 902 (FIG. 9) on and off. The user can press "UP" to turn the rear burner on, and "DOWN" to turn the rear burner off. The remote control unit 1302, via the receiver cartridge, engages the servo motor coupled to the fuel control valve 912 (FIG. 9) to control the flow of fuel to the rear burner 902, as discussed in additional detail herein. In other embodiments, multiple burners 700 and 902 and/or burner chambers may be turned on and off using the remote control unit 1302.

In the standard thermostat mode, the user can manually control the blower, accent lights, flame height, burners, and other features, as described above. In addition, the user selects a desired temperature for the room 120. The user selects the temperature by using the UP/DOWN button 1308. The currently selected temperature is displayed in the upper right hand corner 1320 of the display screen 1312. The remote control unit 1302, via the receiver cartridge, engages the servo motor coupled to the fuel control valve 912 (FIG. 9) to control the flow of fuel to the burners 700 and 902 in order to achieve and maintain the selected temperature in the room 120.

In the smart thermostat mode, the user can manually control the blower, accent lights, and other features, as described above. In addition, the user selects a desired temperature for the room 120. The remote control unit 1302 automatically controls the flow of fuel to the burners 700 and 902 in order to achieve and maintain the selected temperature in the room 120. In contrast to a conventional thermostat that regulates heat by turning burners on or off, the smart thermostat mode automatically adjusts the burner flames up or down for even room 120 temperature and continual flame appearance. In the illustrated embodiment, the remote control unit 1302 engages the servo motor coupled to the fuel control valve 912 (FIG. 9) to modulate the burner flames from low to high, or high to low, until the proper temperature is reached. The smart thermostat mode offers a more efficient way to heat a room 120, by conserving fuel while maintaining a constant room temperature.

Among other benefits, the smart thermostat mode also causes more efficient use of the blower. When the desired room temperature has been reached, the smart thermostat mode shuts off the burner flame. As a result, the firebox 102 (FIG. 1) has a relatively lower temperature, and the amount of time required for the blower to cool down the firebox is relatively shorter.

Conclusion

The above description of illustrated embodiments of the disclosure is not intended to be exhaustive or to limit the invention to the precise form disclosed. While specific embodiments of, and examples for, the disclosure are described herein for illustrative purposes, various equivalent modifications are possible within the scope of the disclosure, as those skilled in the relevant art will recognize. The teachings of the disclosure herein can be applied to other direct vent fireplace assemblies, not necessarily the assemblies described above.

While certain aspects of the disclosure are presented below in certain claim forms, the inventors contemplate the various aspects of the disclosure in any number of claim forms. In general, in the following claims, the terms used should not be construed to limit the disclosure to the specific embodiments disclosed in the specification and claims, but should be construed to include all components and methods of manufacturing the components, in accordance with the claims. Accordingly, the disclosure is not limited by the description, but instead the scope of the disclosure is to be determined entirely by the claims.

From the foregoing, it will be appreciated that specific embodiments of the disclosure have been described herein for purposes of illustration, but that various modifications may be made without deviating from the spirit and scope of the disclosure.

We claim:

1. A fireplace assembly, comprising:

a burner assembly comprising:

multiple independent burners each configured to provide flames that simulates a natural wood-burning fire; and a fuel control valve coupled to the multiple independent burners, the fuel control valve configured to direct a first portion of the flow of fuel to a first burner and a second portion of the flow of fuel to a second burner adjacent to the first burner; and a control panel coupled to the burner assembly, the control panel comprising:

a comfort control switch coupled to the fuel control valve, the comfort control switch configured to inhibit or allow fuel to flow to the second burner to turn the second burner or burner chamber on and off while the first burner continues to receive fuel; and a flame adjust control coupled to the fuel control valve, the flame adjust control configured to increase and decrease the flow of fuel to each burner that is already receiving fuel.

2. The fireplace assembly of claim 1 further comprising:

a pilot flame assembly alternately operable in a standing mode or an intermittent mode, the pilot flame assembly configured to be continually on during the standing mode, and the pilot flame assembly further configured to be intermittently activated during the intermittent mode, and wherein the control panel further comprises:

a pilot switch coupled to the pilot flame assembly, the pilot switch configured to toggle between the standing mode and the intermittent mode; and a burner switch coupled to the pilot flame assembly, the burner switch configured to toggle the pilot flame assembly on and off when the intermittent mode is active.

3. The fireplace assembly of claim 1 wherein the first burner is a rear burner and the second burner is a front burner.

4. The fireplace assembly of claim 1, further comprising:

a remote control device configured to control the comfort control switch and the flame adjust control.

5. The fireplace assembly of claim 4 wherein the remote control device is configured to automatically control the comfort control switch and the flame adjust control in order to at least generally maintain a heat setting in a space in which the fireplace assembly is located.

6. The fireplace assembly of claim 1, further comprising:

a concealment door movable between a closed position and an open position, the concealment door at least substantially hiding the control panel from view when the concealment door is in the closed position, and the concealment door revealing at least a portion of the control panel when the concealment door is in the open position.

7. The fireplace assembly of claim 6, further comprising:

a light source coupled to the concealment door, the light source being activated to illuminate at least a portion of the control panel when the concealment door is in the open position, the light source being deactivated when the concealment door is in the closed position.

8. A fireplace assembly, comprising:

a plurality of burners, each burner configured to produce a flame that simulates a natural wood-burning fire and has a substantial continual flame appearance when gas burns adjacent to an upper surface of the burner; and a gas control valve coupled to the plurality of burners, the gas control valve configured to:

receive a flow of gas from a gas delivery line;

direct a first portion of the flow of gas to a first burner; and direct a second portion of the flow of gas to a second burner generally adjacent to the first burner; and a control area having a control panel with a plurality of controls, the plurality of controls including:

a comfort switch coupled to the gas control valve, the comfort switch configured to inhibit or allow gas to flow from the gas delivery line to one of the plurality of burners; and a flame control coupled to the gas control valve, the flame control configured to increase and decrease the flow of gas to each burner that is already receiving gas from the gas delivery line.

9. The fireplace assembly of claim 8, further comprising:

a pilot flame assembly operable in a continuous mode and a discontinuous mode, the pilot flame assembly being continually on during the continuous mode, and the pilot flame assembly being intermittently activated during the discontinuous mode, and wherein the plurality of controls further include:

a pilot switch coupled to the pilot flame assembly, the pilot switch configured to toggle between the continuous mode and the discontinuous mode; and a burner switch coupled to the pilot flame assembly, the burner switch configured to toggle the pilot flame assembly on and off when the discontinuous mode is in operation.

10. The fireplace assembly of claim 8, further comprising:

a remote control device configured to control at least one of the plurality of controls.

11. The fireplace assembly of claim 8, further comprising:

a concealment panel movable between a first position and a second position, the concealment panel at least substantially concealing the control panel when the concealment panel is in the first position, and the concealment panel exposing at least a portion of the control panel when the concealment panel is in the second position.

12. The fireplace assembly of claim 8, further comprising:

a light coupled to the concealment panel, the light being activated to illuminate at least a portion of the control panel when the concealment panel is in the second position, the light being turned off when the concealment panel is in the first position.

13. A fireplace assembly, comprising:

a control area having a control panel with a plurality of controls;

a concealment door movable between a closed position and an open position, the concealment door at least substantially blocking the control panel from view when the concealment door is in the closed position, and the concealment door revealing at least a portion of the control panel when the concealment door is in the open position;

a light source coupled to the concealment door, the light source being activated to illuminate at least a portion of the control panel when the concealment door is in the open position, the light source being deactivated when the concealment door is in the closed position;

a burner assembly operatively coupled to the control panel, the burner assembly comprising:

a plurality of independent burner portions; and a fuel control valve configured to receive a flow of fuel from a fuel delivery line, the fuel control valve further configured to direct a first portion of the flow of fuel to a first burner portion and a second portion of the flow of fuel to a second burner portion, wherein the fuel control valve is coupled to at least one of the plurality of controls, the at least one control configured to regulate the flow of fuel to at least one of the plurality of burner portions; and a pilot flame assembly alternately operable in a standing mode or an intermittent mode, the pilot flame assembly configured to be continually on during the standing mode, and the pilot flame assembly further configured to be intermittently activated during the intermittent mode.

14. The fireplace assembly of claim 13, further comprising:

a remote control device coupled to the controls and configured to automatically adjust gas flow to the burner assembly to at least generally maintain a heat setting in a space in which the fireplace assembly is located.

15. The fireplace assembly of claim 14 wherein the remote control device is further configured to adjust flames from the burner assembly to at least generally modify the heat setting in the space.

16. The fireplace assembly of claim 13 wherein the light source is mounted to an outer housing of the fireplace assembly, and wherein the light source is coupled to the concealment door via a switch that is engaged by the concealment door.

17. The fireplace assembly of claim 13, further comprising:

an air shutter adjustment positioned in the control area and connected to the burner assembly, the air shutter adjustment configured to adjust air flow to at least one of the burner portions, and the air shutter adjustment being accessible through the control area while the burner assembly is in operation.

18. The fireplace assembly of claim 13 wherein the at least one control comprises a comfort control switch configured to regulate the flow of fuel to the second burner portion to turn the second burner on and off, wherein turning the second burner off reduces heat generated by the burner assembly.

19. The fireplace assembly of claim 13 wherein the at least one control comprises a flame adjust control configured to regulate the flow of fuel to each burner portion.

20. The fireplace assembly of claim 13 wherein the plurality of controls include:

a pilot switch coupled to the pilot flame assembly, the pilot switch configured to toggle between the standing mode and the intermittent mode; and a burner switch coupled to the pilot flame assembly, the burner switch configured to control the pilot flame assembly when the intermittent mode is active.

* * * * *